US006951355B2

(12) United States Patent
Hayakawa et al.

(10) Patent No.: US 6,951,355 B2
(45) Date of Patent: Oct. 4, 2005

(54) DOOR LOCK SYSTEM FOR VEHICLE

(75) Inventors: Shigeru Hayakawa, Chiryu (JP); Hiroshi Ban, Kariya (JP); Norio Konomoto, Nagoya (JP); Katsutoshi Fukunaga, Chiryu (JP); Makoto Suzumura, Kariya (JP); Akira Muramatsu, Chiryu (JP); Yasuhiko Sono, Hekinan (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 215 days.

(21) Appl. No.: 09/809,052

(22) Filed: Mar. 16, 2001

(65) Prior Publication Data

US 2001/0038211 A1 Nov. 8, 2001

(30) Foreign Application Priority Data

Mar. 17, 2000 (JP) ..... 2000-075960

(51) Int. Cl.[7] ..... E05C 3/06
(52) U.S. Cl. ..... 292/201; 292/216; 292/DIG. 23
(58) Field of Search ..... 292/201, DIG. 23, 292/216

(56) References Cited

U.S. PATENT DOCUMENTS

| | | | | | |
|---|---|---|---|---|---|
| 4,575,138 | A | * | 3/1986 | Nakamura et al. | 292/216 |
| 4,875,723 | A | * | 10/1989 | Compeau et al. | 292/201 |
| 4,904,006 | A | * | 2/1990 | Hayakawa et al. | 292/201 |
| 5,088,347 | A | * | 2/1992 | Wanlass | 192/84.951 |
| 5,137,312 | A | * | 8/1992 | Tang | 292/201 |
| 5,584,515 | A | * | 12/1996 | Silye | 292/201 |
| 5,649,726 | A | * | 7/1997 | Rogers, Jr. et al. | 292/201 |
| 5,762,384 | A | * | 6/1998 | Bartel | 292/201 |
| 5,855,130 | A | * | 1/1999 | Rorabacher et al. | 292/201 |
| 6,076,868 | A | * | 6/2000 | Roger et al. | 292/201 |
| 6,102,453 | A | * | 8/2000 | Cetnar | 292/199 |
| 6,109,674 | A | * | 8/2000 | Bartel et al. | 292/201 |
| 6,142,540 | A | * | 11/2000 | Girard et al. | 292/169.11 |
| 6,497,436 | B1 | * | 12/2002 | DeBlock et al. | 292/216 |

FOREIGN PATENT DOCUMENTS

| | | |
|---|---|---|
| EP | 0 142 319 A2 | 5/1985 |
| EP | 0 894 922 A1 | 2/1999 |
| GB | 2 207 698 A | 2/1989 |
| GB | 2 208 240 A | 3/1989 |
| GB | 2 221 719 A | 2/1990 |
| GB | 2 240 583 A | 8/1991 |
| GB | 2 257 467 A | 1/1993 |
| GB | 2 330 864 A | 5/1999 |
| GB | 2 335 946 A | 10/1999 |
| GB | 2 350 644 A | 12/2000 |
| JP | 7-150845 | 6/1995 |
| JP | 7-103735 | 11/1995 |
| JP | 8-3631 Y2 | 1/1996 |
| WO | WO 85/00191 | 1/1985 |

* cited by examiner

*Primary Examiner*—Robert J. Sandy
*Assistant Examiner*—Thomas Ho
(74) *Attorney, Agent, or Firm*—Burns, Doane, Swecker & Mathis, L.L.P.

(57) ABSTRACT

A door lock system for a vehicle includes a latch mechanism, a link mechanism and a housing. The latch mechanism is adapted to a vehicle door and latches the vehicle door to a vehicle body. The link mechanism includes an electric driving source and a plurality of lever members for selectively locking and unlocking the latch mechanism. The housing accommodates the latch mechanism and the link mechanism.

16 Claims, 12 Drawing Sheets

DOOR LOCK SYSTEM FOR VEHICLE

This application is based on and claims priority under 35 U.S.C. § 119 with respect to Japanese Patent Application No. 2000-075960 filed Mar. 17, 2000, the entire contents of which is herein incorporated by reference.

BACKGROUND OF THE INVENTION

1. Field of the Invention

This invention relates to a door lock system for a vehicle.

2. Description of Related Arts

A type of door lock system for a vehicle is proposed in a Japanese Patent Publication H7-103735 published on Nov. 8, 1995. The door lock system for the vehicle comprises a) a latch mechanism including a latch which is provided in a vehicle door and which engages a striker secured to a vehicle body, and b) a link mechanism-including plurality of lever members and an electric actuator member for selectively locking or unlocking the engagement between the latch and the striker.

In the above door lock system for the vehicle, all structural members of the link mechanism of the door lock system are supported by a base plate disposed in the door. Some of the structural members of the link mechanism are accommodated within the base plate, but other members are exposed outside of the base plate. Thus, the members exposed outside of the base plate may be operated from the outside of the vehicle through a gap between the door and the body of the vehicle. In this case, the door lock may be unlocked thereby allowing the door to be opened. In addition, the structure members of the link mechanism exposed outside of the base plate may be exposed to water which can enter the door.

To overcome the above problems, a protector is provided on the base plate for accommodating the structural members, which are exposed outside of the base plate, within the protector. However, the protector has to be added from outside as an additional member of the link mechanism, whereby the manufacturing cost, labor for assembling and the number of members are increased. Furthermore, the door lock system, as a whole, is oversized. Accordingly, it is preferable to accommodate all structural members within the closed housing.

In this case, a problem in determining how compactly the structural members, which are exposed outside of the base plate, can be accommodated in the closed housing. A main member exposed outside of the base plate is the electric actuator member, which is large in size compared to the other structural members. Thus, it becomes a more serious problem to compactly structure the connecting portion between an output portion of the electric actuator member and an operating means which selectively locks or unlocks the engagement of the latch mechanism within the closed housing.

SUMMARY OF THE INVENTION

It is, therefore, necessary for a door lock system to address at least the foregoing drawbacks of the related art.

According to the present invention, the door lock system for a vehicle includes a) a latch mechanism which is adapted to a vehicle door and which holds or latches the vehicle door to a vehicle body, b) a link mechanism including an electric driving source and a plurality of lever members for selectively locking and unlocking the latch mechanism, c) a housing accommodating the latch mechanism and the link mechanism.

BRIEF DESCRIPTION OF THE DRAWINGS

These and other objects of the invention will become more apparent from the following embodiments of the invention with reference to the attached drawings in which.

DESCRIPTION OF THE PREFERRED EMBODIMENT

An embodiment of this invention will be described below referring to FIGS. 1–8. Each direction of the arrows in FIG. 1 indicates longitudinal, vertical and width directions of the vehicle.

Figure 4:
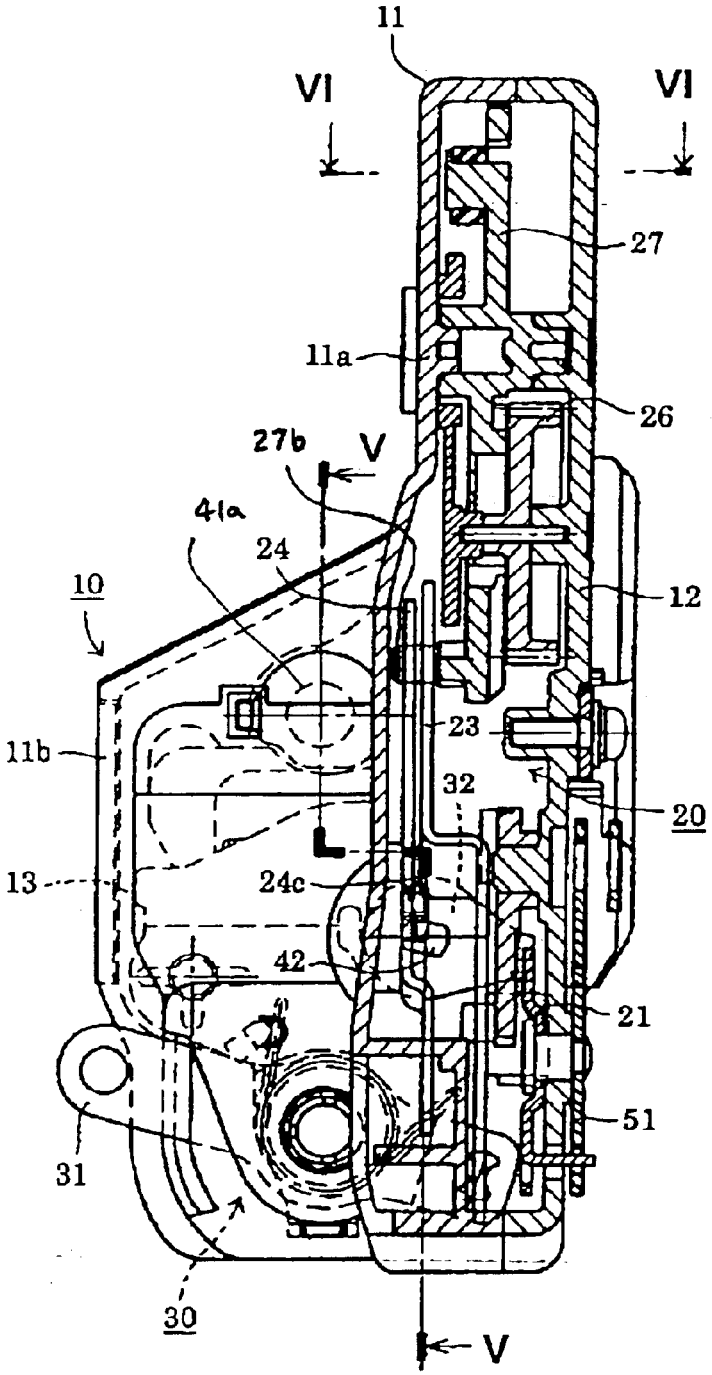
FIG. 4 shows a vertical cross-sectional view of a part of the door lock system.

The door lock system is disposed within a door of the vehicle, and is formed to accommodate a first link mechanism 20 and a second link mechanism 30 in a housing 10 (see FIG. 4). The housing 10 comprises a main body 11, a first cover 12 and a second cover 13. The main body 11 includes a) a first casing portion 11*a* (see FIG. 2) which has a dish shape open to the vehicle inside direction and b) a second casing portion 11*b* (see FIG. 2) which has a dish shape perpendicular to the first casing portion 11*a* and which is open to the vehicle back side direction. The first casing portion 11*a* and the second casing portion 11*b* are integrally formed therewith. The first cover 12 is attached to the first casing portion 11*a* at the opening side thereof. The second cover 13 is attached to the second casing portion 11*b* at the opening side thereof. Thus, the opening of the first casing portion 11*a* is closed by the first cover 12, and the opening of the first casing 11*b* is closed by the second cover 13.

In the housing 10, both a) an electric distribution plate 14 which is electrically connected to an electric motor 25 acting as an actuator and b) structural members of the first link mechanism 20 are disposed so as to be accommodated between the first casing portion 11*a* and the first cover 12. A sub base plate 15 and structural members of the second link mechanism 30 are accommodated between the second casing portion 11*b* and the second cover 13. A base plate 16 is attached to the second cover 13 at an opening side thereof. Thus, the opening of the second cover 13 is closed and covered by the base plate 16. Each structural member of a latch mechanism 40 is accommodated between the inside of the second cover 13 and the base plate 16.

Figure 8:
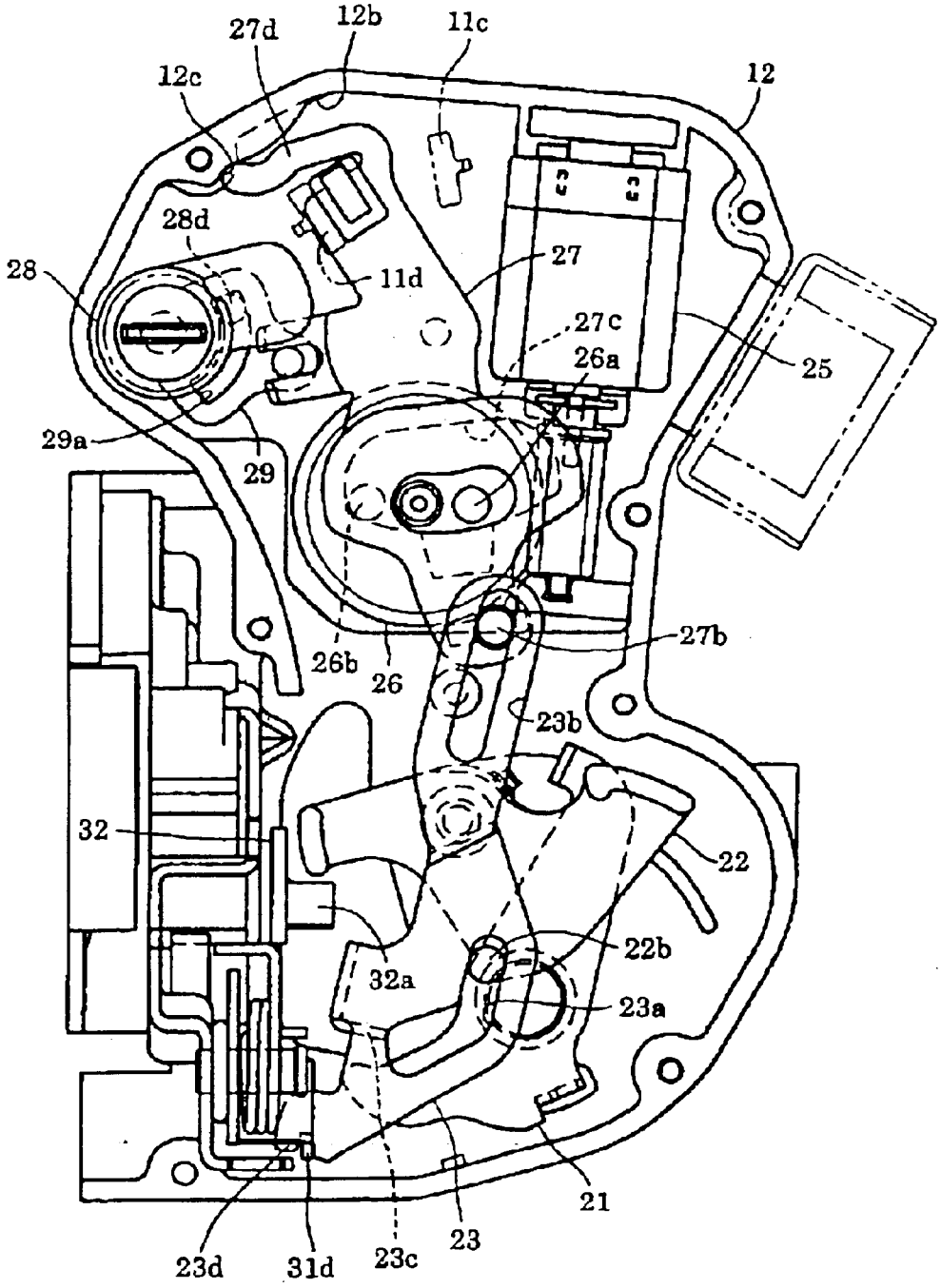
FIG. 8 shows a side view of an inside of the door lock system in an locked state.
Figure 9:
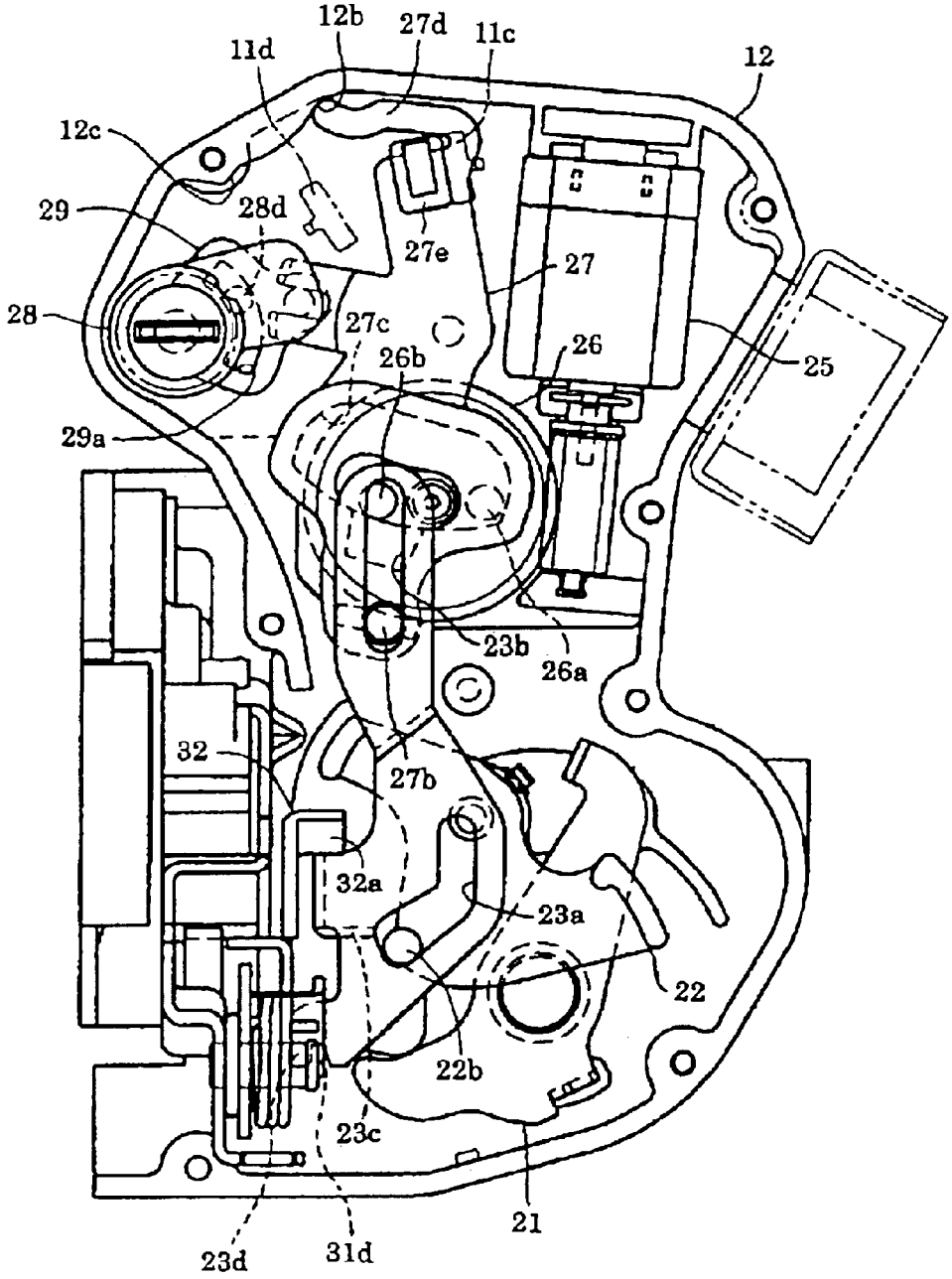
FIG. 9 shows a side view of the inside of the door lock system which is in the unlocked state when an outside handle is operated.

A first inside lever 21 is rotatably supported on the inside of the first cover 12 by a supporting pin 21*a* (see FIG. 2) so as to be rotatably movable in vertical and longitudinal directions of the vehicle. A second inside lever 51 is rotatably supported on the outside of the first cover 12 by the supporting pin 21*a* so as to be rotatably movable in vertical and longitudinal directions of the vehicle. The first inside lever 21 has an engaging projection 21*b* (see FIG. 2) which extends in the vehicle inside direction through a sector-shaped hole 12*a* formed in the first cover 12. The engaging portion 21*b* of the first inside lever 21 engages with a connecting hole 51*a*, whereby the engaging projection 21*b* connects the first inside lever to the second inside lever 51 as one unit. The first inside lever 21 has an engaging projection 21*c* which extends in the vehicle outside direction. When the first inside lever 21 is rotated in a clockwise direction as shown in FIG. 8, the engaging projection 21*c* engages with a canceling lever 22. The canceling lever 22 is then rotated.

Figure 1:
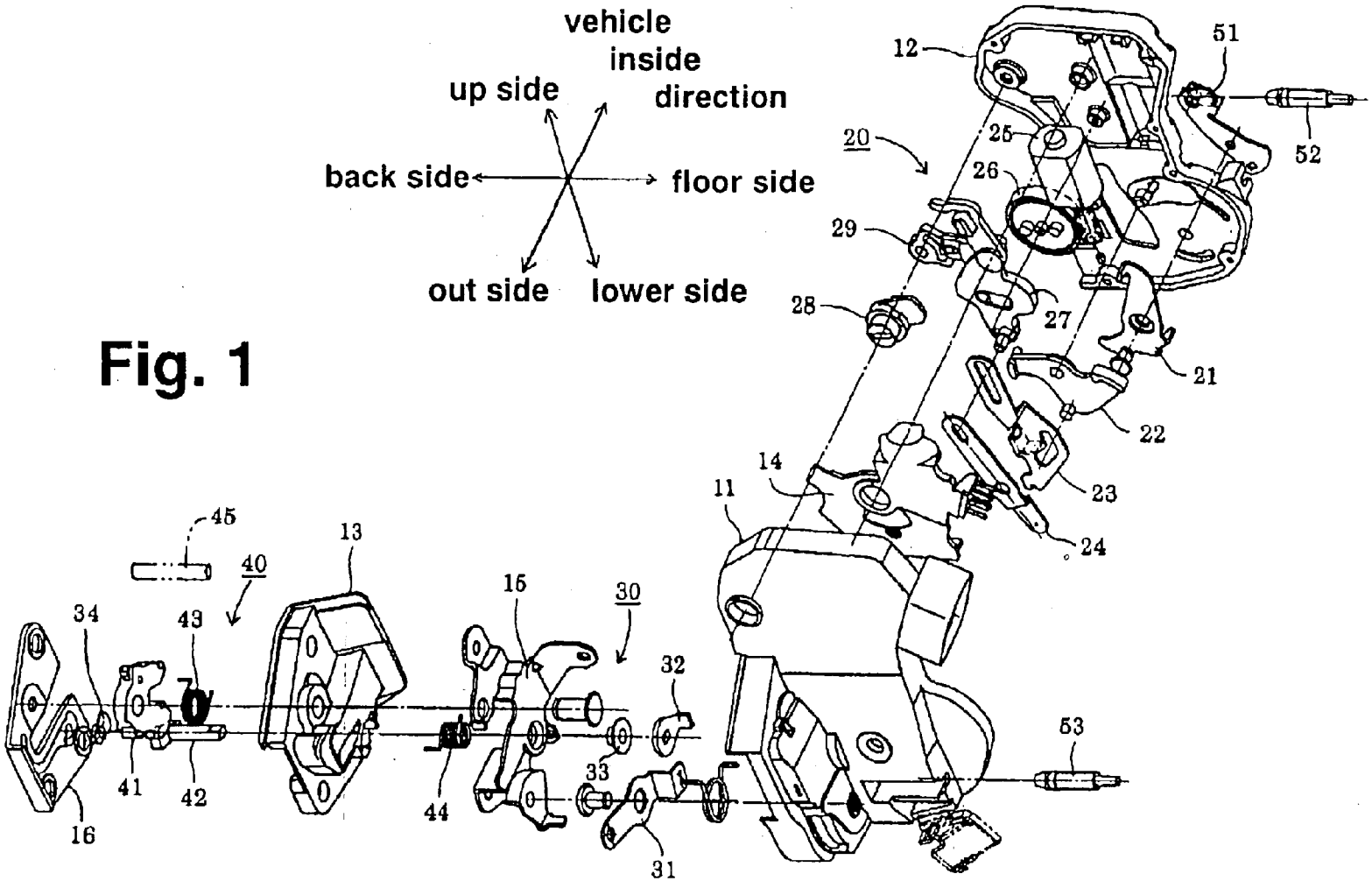
FIG. 1 shows an exploded perspective view of a door lock device of an embodiment of this invention.
Figure 2:
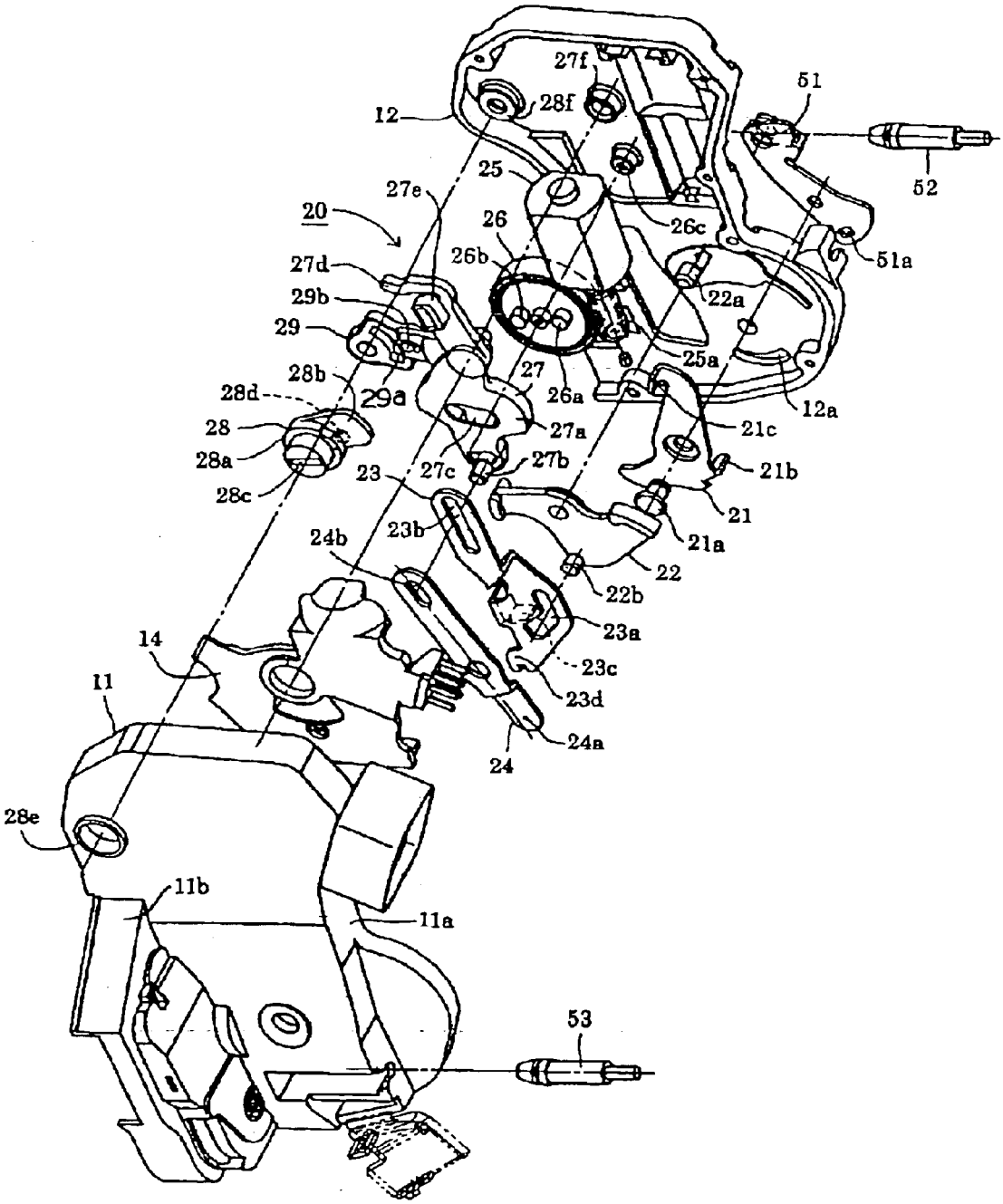
FIG. 2 shows an enlarged perspective view of one part of FIG. 1.
Figure 7:
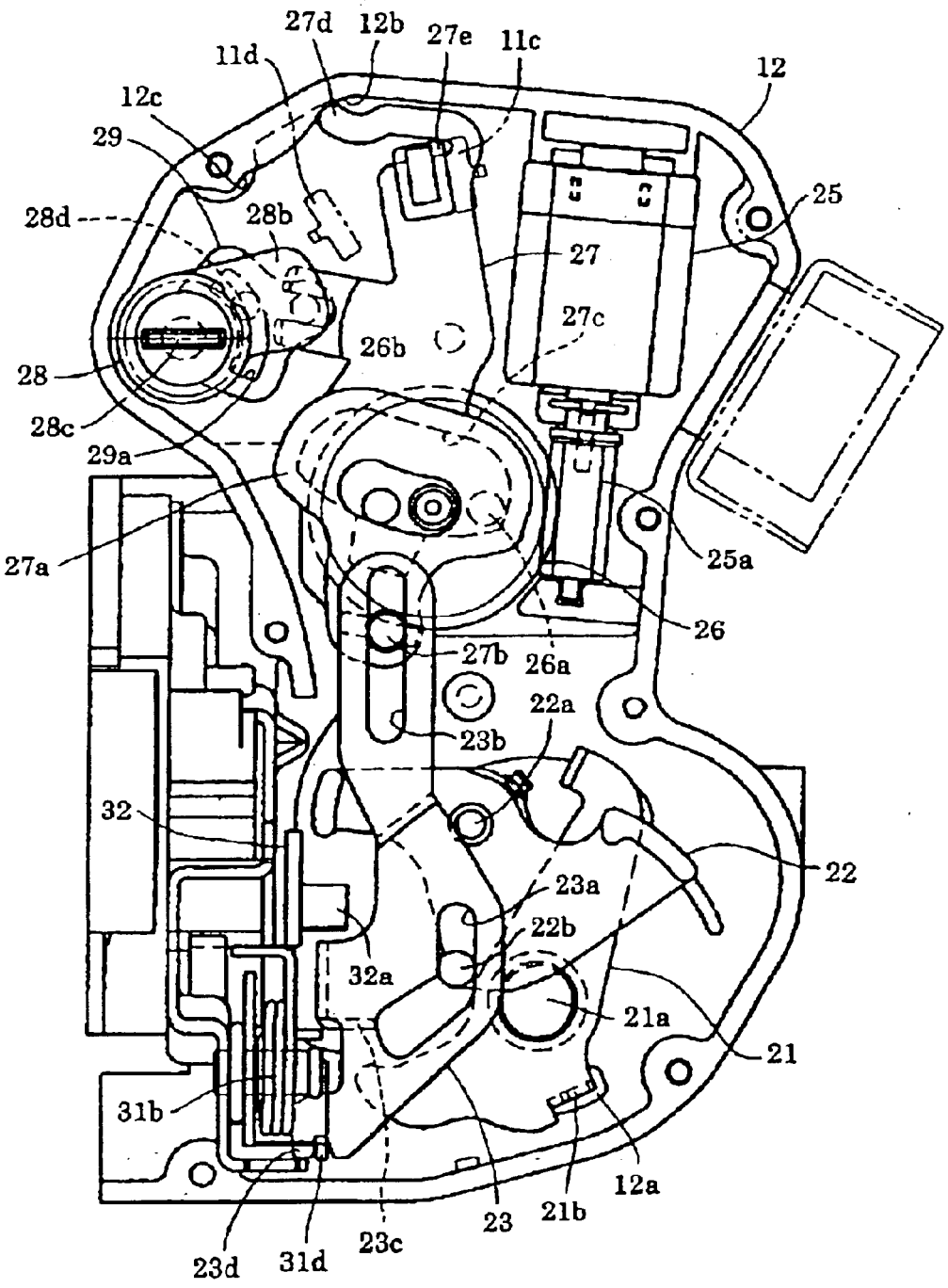
FIG. 7 shows a side view of structural members of the door lock system in an unlocked stage.

The second inside lever 51 is connected with an inside cable 52 which is connected with an inside handle (not shown) disposed inside of the vehicle. The rotation of the inside handle in a door opening direction (the operation for opening the door using the inside handle) causes the second inside lever 51 to rotate in a clockwise-direction as indicated in FIG. 1, FIG. 2 and FIG. 7, thereby rotating the first inside lever 21 in the same direction.

The canceling lever 22 is rotatably supported at the inside of the first cover 12 by a supporting pin 22*a* formed integrally with the first cover 12. The canceling lever 22 is provided adjacent the first inside lever 21 in the vehicle outside direction to be parallel to the first inside lever 21. The canceling lever 22 has an engaging pin 22*b* which extends in the vehicle outside direction. The engaging pin 22*b* is inserted into a first engaging groove 23*a* which is formed as a V-shaped slot. The groove 23*a* is formed in an open link 23 which is disposed adjacent the canceling lever 22 in the vehicle outside direction.

The open link 23 has an elongated second engaging groove 23*b* wherein an engaging pin 27*b* of an active lever 27 is inserted. An engaging portion 23*c*, which is formed as a L-shaped plate, engages with an end of the first inside lever 21. A connecting portion 23*d* connects the open link 23 to an opening lever 31. The open link 23 is supported by the canceling lever 22, the active lever 27 and the opening lever 31.

The locking lever 24 is rotatably supported on an inside of the first casing portion 11*a* by a supporting pin 24*c* (FIG. 4) formed integrally with the main body 11 to be rotatably movable in the vertical and longitudinal directions of the vehicle. The locking lever 24 is provided in parallel with the open link 23. The locking lever 24 has an attachment hole 24*a* which is fixed to a locking cable 53. An elongated engaging groove 24*b* has inserted therein an engaging pin 27*b* of the active lever 27. The locking cable 53 is connected with a locking knob (not shown) which is disposed on an inside of a door of the vehicle. When the locking knob is operated for locking the door, the locking cable 53 transmits an operation force from the locking knob to the locking lever 24, thereby rotating the locking lever 24 in the clockwise direction as shown in FIG. 1.

The electric motor 25 generates the operation force for moving the first link mechanism 20. The electric motor 25 is attached to the inside of the first cover 12. The electric motor 25 includes a worm gear 25*a* at an output shaft of the electric motor 25. The worm gear 25*a* is in mesh engagement with a wheel gear 26. The wheel gear 26 has a pair of engaging pins 26*a*, 26*b* on an outside thereof. The wheel gear 26 is rotatably supported on the inside of the first cover 12 by a supporting boss 26*c* formed integrally with the first cover 12. Both engaging pins 26*a* and 26*b* are arranged at both sides of the rotational center of the wheel 26 in the longitudinal direction of the vehicle such that a predetermined space is defined between engaging pins 26*a* and 26*b*. Either engaging pin 26*a* or 26*b* extends into an engaging concave portion 27*c* of the active lever 27.

The active lever 27 is disposed between the wheel gear 26 and the open link 23. The active lever 27 is rotatably supported on the inside of the first cover 12 by a supporting boss 27*f* formed integrally with the first cover 12. The active lever 27 includes a main lever portion 27*a*, a projecting portion 27*d* having a spring function and a rubber cushion 27*e*. The main lever portion 27*a* has the engaging pin 27*b* projecting in the vehicle outside direction and an engaging concave portion 27*c* opening in a vehicle inside direction. The projecting portion 27*d* is provided at an upper end of the main lever portion 27*a*. The rubber cushion 27*e* is disposed on the portion between the main lever portion 27*a* and the projecting portion 27*d*. The engaging pin 27*b* of the active lever 27 extends through the second engaging groove 23*b* of the open link 23 and the engaging groove 24*b* of the locking lever 24. The engaging concave portion 27*c* of the active lever 27 has either engaging pins 26*a* or 26*b* extending thereinto. An end of the projecting portion 27*d* of the active lever 27 elastically contacts an inner periphery of the first cover 12. The engaging concave portion 27*c* of the active lever 27 is formed so that either the front engaging pin 26*a* or the rear engaging pin 26*b* can be engaged with the active lever 27 when the wheel gear 26 is rotated in either the normal or the reverse directions. The active layer 27 can be rotated in either the clockwise direction or the counter-clockwise direction as shown in FIGS. 7 and 8. The end of the projecting portion 27*d* slidably moves on the inner periphery of the first cover 12 and selectively engages with either of these engaging concave portions 12*b* or 12*c* (FIG. 7). The rubber cushion 27*e* selectively contacts either stopper portions 11*c* or 11*d* in accordance with the above motion of the projecting portion 27*d*.

A key lever 28 has a cylinder-shaped main body 28*a* and a lever port ion 28*b* formed integrally with the cylinder-shaped main body 28*a*. The key lever 28 and an idle lever 29 are rotatably supported by a supporting boss 28*e* (see FIG. 2) formed integrally with the first casing portion 11*a* and a supporting boss 28*f* formed integrally with the first cover 12. The key lever 28 has an engaging groove 28*c* provided in the main body 28*a* and an engaging pin 28*d* provided on the lever portion 28*b* at the opposite side thereof (FIG. 2). An end of a projecting pin of a key cylinder (not shown), which is disposed on the outside of the door, is disposed into the engaging groove 28*c*. The engaging pin 28*d* extends into a sector-shaped engaging groove 29*a* formed in the idle lever 29. The key lever 28 is rotated by the rotation of the key cylinder turned by a key (not shown). The key lever 28 rotates the idle lever 29 via the engaging pin 28*d*. Then, the idle lever 29 selectively rotates the active lever 27 in the clockwise direction or the counter-clockwise direction (as indicated in FIGS. 7 and 8) via a connecting pin 29*b* formed integrally with the idle lever 29.

Figure 3:
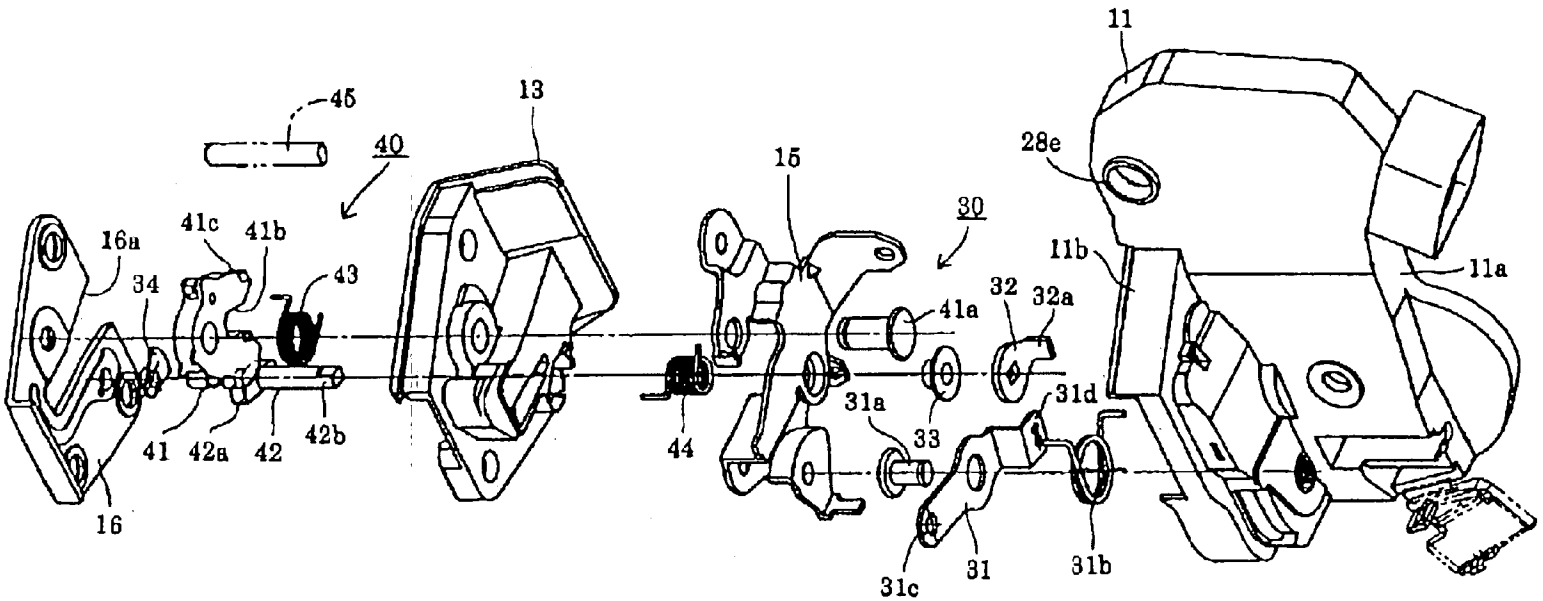
FIG. 3 shows an enlarged perspective view of the other part of FIG. 1.

Each structural member of the second link mechanism 30 is accommodated between the second casing portion 11*b* of the main body 11 and the second cover 13 as shown in FIG. 3. The opening lever 31 of the second link mechanism 30 is rotatably supported on the second casing portion 11*b* and the sub base plate 15 by a supporting pin 31*a* via a torsion spring 31*b*. The opening lever 31 is rotatably movable in vertical and width directions of the vehicle between the second casing portion 11*b* and the sub base plate 15. A rotating end 31*c* of the opening lever 31 is connected with an outside link. The outside link is connected to an outside handle (not shown) which is disposed on the outside of the door. The opening lever 31 is rotated in a counter-clockwise direction as indicated in FIG. 4 against the force of the torsion spring 31*b* by the operation of the outside handle in a door opening direction (the operation for opening the door using the outside handle). A lifting lever 32 is disposed on a periphery of a shaft 42*b* for unitary rotation therewith. The shaft 42*b* is extended through the second cover 13 via a bush 33. An engaging portion 32*a*, formed on periphery of the lifting lever 32, is extended above the upper end of the engaging portion 23*c* of the open link 23.

Figure 5:
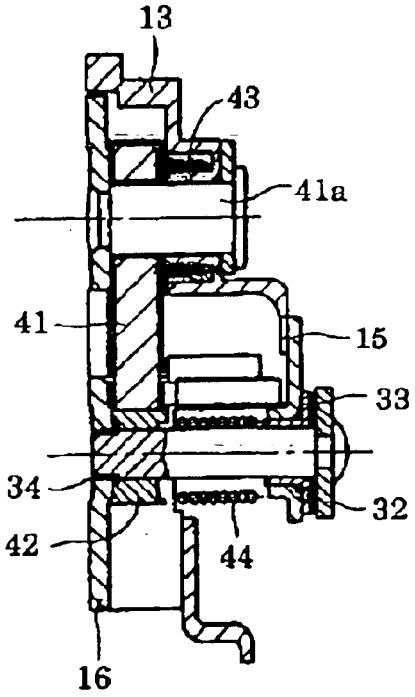
FIG. 5 shows a vertical cross-sectional view of FIG. 4 taken along the lines V—V.
Figure 6:
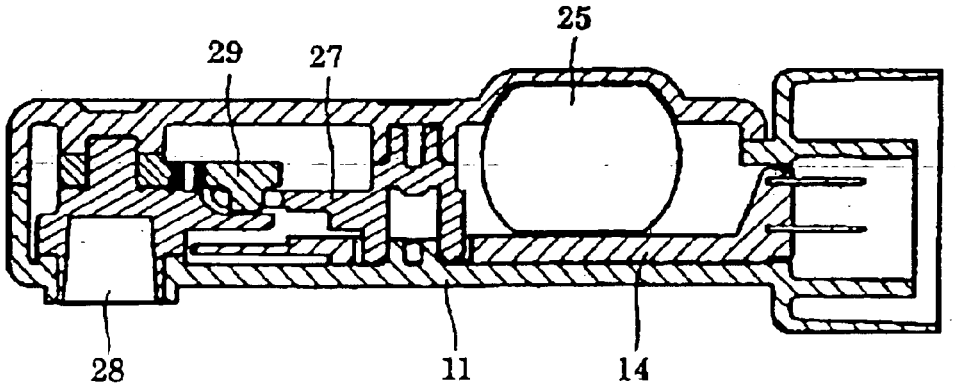
FIG. 6 shows a horizontal cross-sectional view of FIG. 4 taken along the lines VI—VI.

The latch mechanism 40 includes a latch 41, a pawl 42, a pair of torsion springs 43 and 44 applying spring forces to the latch 41 and the pawl 42, respectively. The latch 41 is rotatably supported between the second cover 13 and the base plate 16 by a supporting pin 41*a*. The supporting pin 41*a*, extending through the sub base plate 15, the second cover 13 and the base plate 16, is supported by both the second cover 13 and the base plate 16. One end of the torsion spring 43, which is provided on the supporting pin 41*a*, is engaged with the latch 41. The other end of the torsion spring 43 is engaged on the second cover 13. The torsion spring 43 applies the predetermined spring force to the latch 41 for regulating the rotation of the latch 41 so that the latch 41 can be returned to its initial position by the spring force when the latch 41 is rotated to be out of an initial position thereof. The latch 41 is held by the torsion spring 43 so that an opening of a latch groove 41*b* can substantially coincide with an opening of an insertion groove 16*a* formed in the base plate 16. The pawl 42 includes a block-like main pawl body 42*a* and a shaft 42*b* extending approximately perpendicular to the main pawl body 42*a*. The shaft 42*b* extends into the second casing portion 11*b* through the second cover 13 and the sub base plate 15 via the bush 33. The shaft 42*b* is rotatably supported by the sub base plate 15 via the bush 33. The shaft 42*b* is further rotatably supported by the base plate 16 via the bush 34. The torsion spring 44 is provided on the shaft 42*b* at the middle portion between the main pawl body 42*a* and sub base plate 15. The lifting lever 32 is rigidly connected to one end of the shaft 42*b* for unitary rotation therewith (after the torsion spring 44 is provided on the shaft 42*b*, the end of shaft 42*b* is disposed into the lifting lever 32 and formed with a head by riveting as shown in FIG. 5). One end of the torsion spring 44 is engaged with the pawl 42. The other end of the torsion spring 44 is engaged with the sub base plate 15. The torsion spring 44 applies a predetermined spring force to the shaft 42*b* for regulating the rotation of the shaft 42*b* so that the pawl 42 can be returned to its initial position by the spring force when the pawl 42 is rotated. The pawl 42 causes the main pawl body 42*a* to contact the periphery of the latch 41.

When a striker 45, which is mounted on a body of the vehicle, moves relatively into the latch 41 through the insertion groove 16*a*, the latch 41 is rotated by the pressure from the striker 45 against the spring force of the torsion spring 43. The latch 41 then receives the striker 45. While the latch 41 receives the striker 45, the pawl 42 slidably contacts on the outer periphery of the latch 41. The pawl 42 moves into a latch portion 41*c* to be engaged thereon. The pawl 42 holds the latch 41 which has been rotated to receive the striker 45. Thus, the pawl 42 keeps the latch 41 engaged with the striker 45. Under the above state, the door of the vehicle is closed. Under the above engagement state, the latch 41 is returned to an initial position thereof by the force of the torsion spring 43. When the pawl 42 is rotated to be moved away from the latch portion 41*c* by the rotation of the lifting lever 32, while the latch 41 is returned by the spring force of the torsion spring 43, the opening of the latch groove 41*b* is rotated to match the opening direction of the insertion groove 16*a*. Under the above state, the striker 45 can be moved away from the latch groove 41*b* and the opening of the insertion groove 16*a* of the base plate 16. The door of the vehicle can then be opened.

The pawl 42 functions for selectively holding between the engaging condition in which the latch 41 engages with the striker 45 and the disengaging condition in which the latch 41 disengages from the striker 45. When the pawl 42 is rotated against the spring force of the torsion spring 44, the pawl 42 is moved away from the latch portion 41*c* of the latch 41. The pawl 42 then changes to the disengaging condition between the latch 41 and the striker 45 from the engaging condition between the latch 41 and the striker 45. As illustrated in FIG. 7, the electric driving source 25 is positioned in the upper portion of the housing. More specifically, as shown in FIG. 7, the electric driving source 25 is located above the engaging pin 27*b* of the active lever 27, and the engaging pin 27*b* is positioned relative to the supporting pin 41*a* of the latch 41 in the manner shown in FIG. 4. Further, as shown in FIG. 3, the supporting pin 41*a* is positioned above the insertion groove 16*a* into which the striker 45 is movable to be received by a portion of the latch mechanism to latch the vehicle door to the vehicle body. Thus, the entire electric driving source 25 is positioned above the insertion groove 16*a*.

The operation modes of the door lock system consists of the operation modes causing the door lock system be in the unlocked state capable of releasing the engagement between the latch 41 and the striker 45, the operation modes causing the door lock system be in the locked state incapable of releasing the engagement between the latch 41 and the striker 45, and the operation modes causing the door to open or to close when the door lock system is in the unlocked state. The eight operation modes will be described as follows.

First operation mode: The door is opened by operating the inside handle disposed on the inside of the vehicle when the door lock system is in the unlocked state as viewed in FIG. 7. In the door lock system, when the inside handle is operated to open the door, the second inside lever 51 is rotated in a clockwise direction (as indicated in FIG. 1) via the inside cable 52. The first inside lever 21 is rotated by the second inside lever 51 in a clockwise direction (as indicated in FIG. 7). When the first inside lever 21 is rotated in the clockwise direction (as indicated in FIG. 7), the end of the inside lever 21 engages with the lower surface of the engaging portion 23*c* of the open link 23 and pushes up the open link 23. The open link 23 causes the upper periphery of the engaging portion 23*c* to engage with the engaging portion 32*a* of the lifting lever 32. The lifting lever 32 is then rotated by the open link 23. The pawl 42 is rotated by the lifting lever 32 to be moved away from the latch portion 41*c* of the latch 41. Namely, a regulation of the rotation of the latch 41 by the engagement with the main pawl body 42*a* is released. Thus, the latch 41 is returned to its initial position by the spring force of the torsion spring 43. When the latch 41 is separated from the striker 45 by a force of the door opening, the latch 41 releases the striker 45. Then, the latch 41 is separated from the striker 45. Thus the engagement between the latch 41 and the striker 45 is released by operating the inside handle to open the door. The door can then be opened.

Second operation mode: The door is opened by operating the outside handle disposed on the outside of the vehicle when the door lock system is in the unlocked state as viewed in FIG. 7. In the door lock system, when the outside handle is operated to open the door, the opening lever 31 is rotated against the torsion spring 31*b*. The open link 23 is then pushed up by the opening lever 31. The open link 23 causes the upper periphery of the engaging portion 23*c* to engage with the engaging portion 32*a*. The lifting lever 32 is then rotated by the open link 23. The lifting lever 32 rotates the pawl 42 to be separated from the latch portion 41*c* of the latch 41. Namely, a regulation of the rotation of the latch 41 by the engagement with the main pawl body 42*a* is released. Thus, the latch 41 is returned to its initial position by the spring force of the torsion spring 43. When the latch 41 is separated from the striker 45 by a force of the door opening, the latch 41 releases the striker 45. Then, the latch 41 is separated from the striker 45. Thus the engagement between the latch 41 and the striker 45 is released by operating the outside handle to open the door. The door can then be opened.

In the first and second operation modes, when the open link 23 is pushed up by the opening lever 31 or the first inside lever 21, the canceling lever 22 is rotated in the counterclockwise direction as shown in FIG. 7 by the engagement between the first engaging groove 23*a* of the open link 23 and engaging pin 22*b* of the canceling lever 22.

Figure 10:
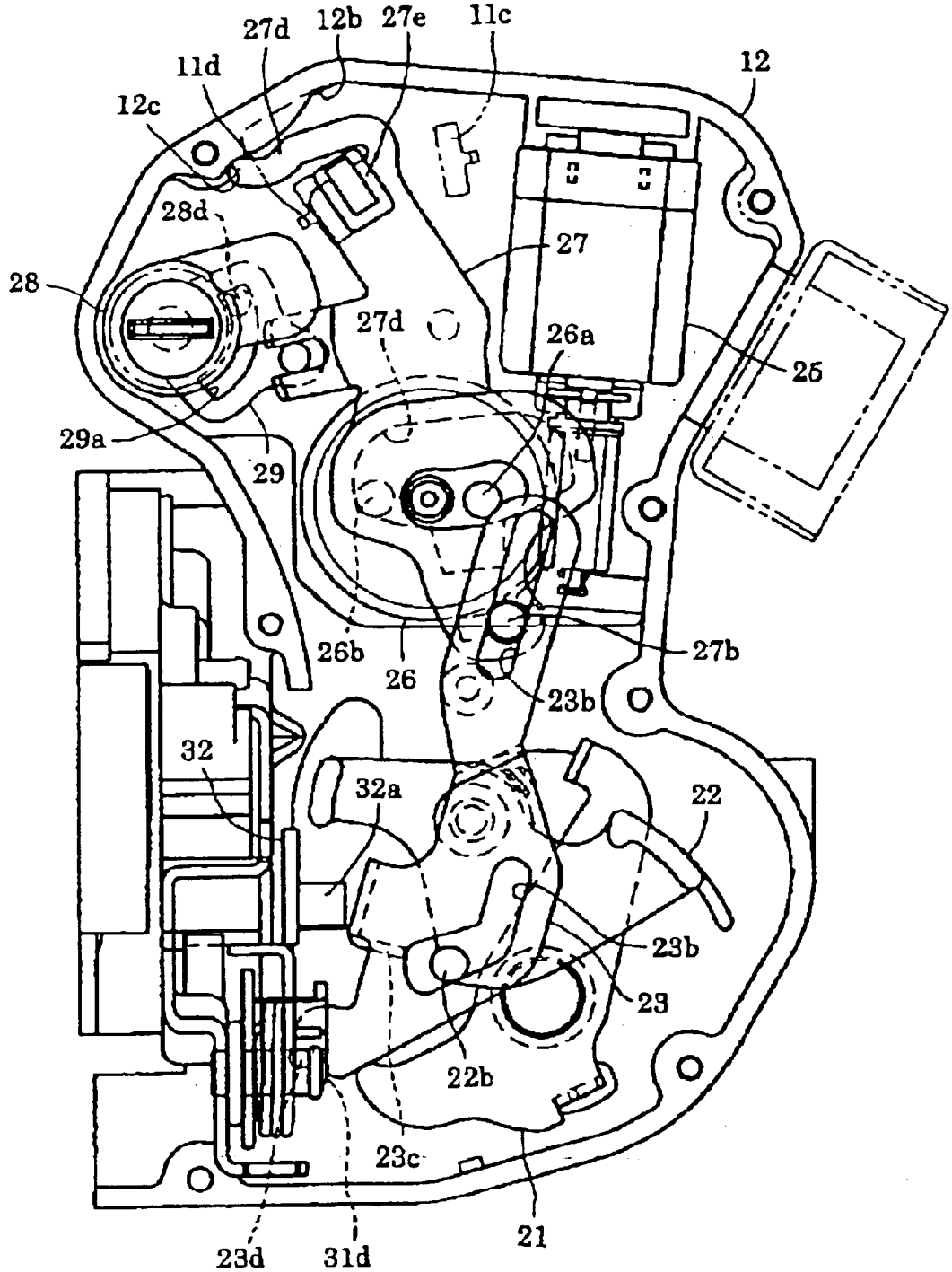
FIG. 10 shows a side view of the inside of the door lock system in a locked state when the inside or outside handle is operated.

Third operation mode: The door lock system, by operating the locking knob inside the vehicle, is brought into the locked state such that the engagement between latch 41 and the striker 45 is impossible. When the door lock system is in the unlocked state as viewed in FIG. 7, the locking cable 53 is moved by operating the locking knob. The locking lever 24 is rotated, and then the active lever 27 is rotated in the counterclockwise direction as shown in FIG. 7. Thus the active lever 27 causes the open link 23 to rotate about the connecting portion between the open link 23 and the opening lever 31 by the engagement between the second engaging groove 23*b* and the engaging pin 27*b*. The open link 23 is thereby shifted from the unlocking position shown in FIG. 7 to the locking position shown in FIG. 8. The unlocking position is the position for the open link 23 which causes the door lock system to be in the unlocked state. The lock position is the position for the open link 23 which causes the door lock system to be in the locked state. Even if the open link 23 is moved as viewed in FIG. 10 by operating the inside handle or the outside handle, the open link 23 fails to engage with the lifting lever 32, whereby the lift lever 32 and the pawl 42 are not rotated. Thus, even if the inside handle or the outside handle are operated for opening the door, the unlocked state for releasing the engagement between the latch 41 and the striker 45 is not established. Thus, the locked state remains, and the door can not be opened. When the open link 23 is moved from the unlocking position shown in FIG. 7 to the locking position shown in FIG. 8, the canceling lever 22 is rotated in the counterclockwise direction shown in FIG. 8 by the engagement between the first engaging groove 23*a* of the open link 23 and the engaging pin 22*b*.

Fourth operation mode: The door lock system is brought into either the locked state or the unlocked state by a key operated rotation of the key cylinder from outside of the vehicle. In the door lock system, when the key cylinder is rotated by the key, the key lever 28 is rotated. The active lever 27 is then selectively rotated by the key lever 28 via the idle lever 29 to be in either the position shown in FIG. 7 or the position shown in FIG. 8. The open link 23 is selectively moved by the active lever 27 to be in the unlocking position shown in FIG. 7 or the locking position shown in FIG. 8 via the engagement between the second engaging groove 23*b* and the engaging pin 27*b*. The rotation of the key cylinder, by manipulating the key, causes the door lock system to be selectively in either a) the unlocked state which is capable of releasing the engagement between the latch 41 and the striker 45 or b) the locked state which is incapable of releasing the engagement.

Fifth operation mode: The door lock system is brought into either the locked state or the unlocked state when the electric motor 25 is remotely-controlled by operating a remote device control, such as a lock-unlock switch which acts as a key, from outside of the vehicle. In the door lock system, when the lock/unlock switch is operated, the electric motor 25 rotates the wheel gear 26 through a predetermined rotation amount via the worm gear 25*a*. When the wheel gear 26 rotates one or the other direction, either of the engaging pins 26*a* or 26*b* selectively engages a part of engaging concave portion 27*c* of the active lever 27. The active lever 27 is then rotated to the position shown in FIG. 7 or the position shown in FIG. 8. Therefore, the open link 23 is selectively moved to the unlocking position shown in FIG. 7 or the locking position shown in FIG. 8 via the engagement between the second engaging groove 23*b* and the engaging pin 27*b*. Thus the operation of the lock/unlock switch causes the door lock system to be selectively in either a) the unlocked state which is capable of releasing the engagement between the latch 41 and the striker 45 by the opening operation of the outside handle or b) the locked state which is incapable releasing the engagement.

Figure 11:
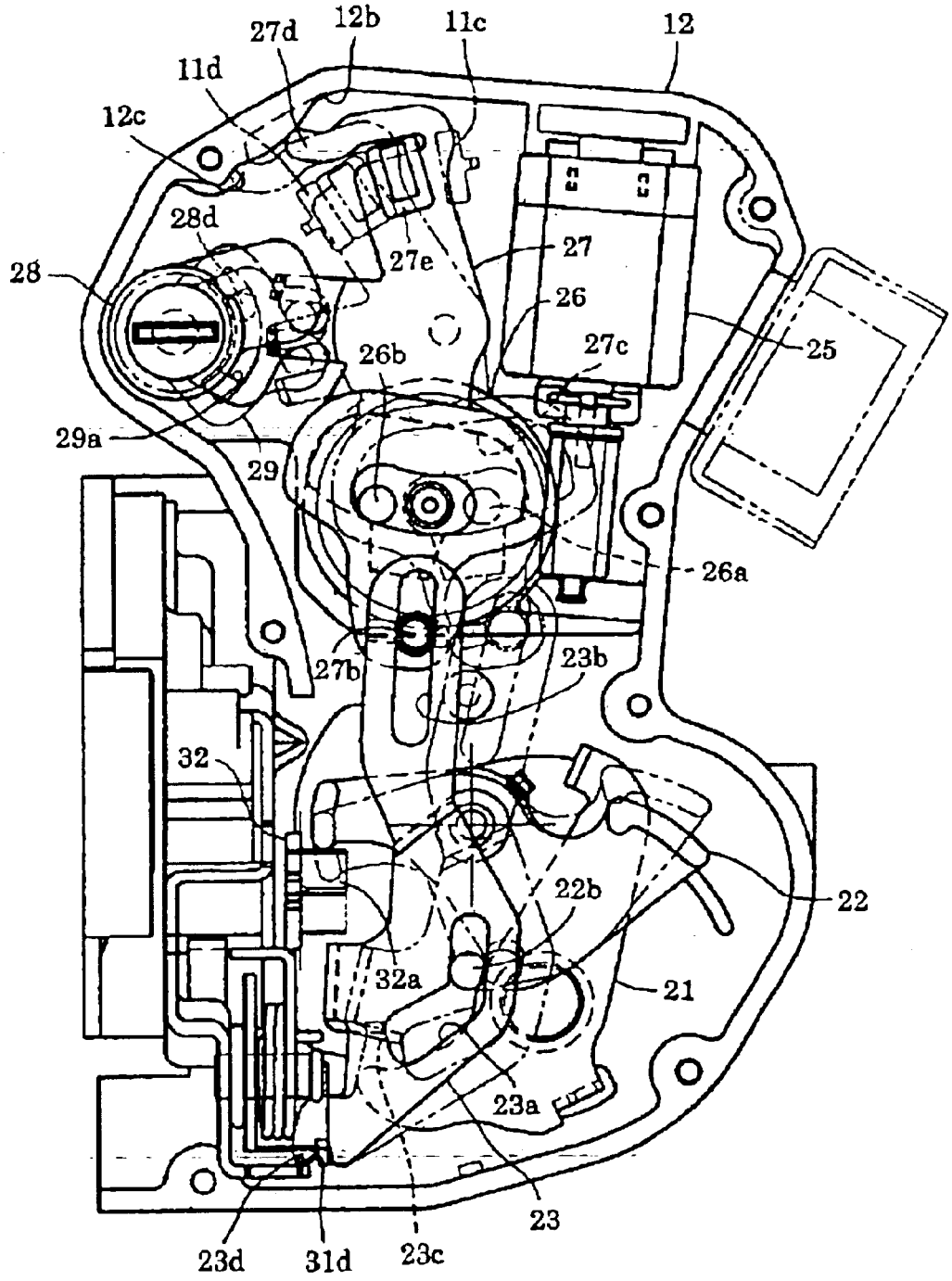
FIG. 11 shows a side view of the inside of the door lock system in a canceling operation.

Sixth operation mode (canceling operation): The door is closed without operating a door handle such as the outside handle or the inside handle after bringing the door lock system into the locked state by a manual operation of the locking knob while the door is open. In the door lock system, as the door is closed, the striker 45 causes the latch 41 to rotate. Accordingly, the pawl 42 rotates by the rotation of the latch 41. Then the lifting lever 32 rotates from the position shown by two-dot-lines in FIG. 11 to the position shown by solid lines in FIG. 11, thereby rotating the canceling lever 22 from the position shown by the two-dot-lines in FIG. 11 to the position shown by the solid lines in FIG. 11. Thus the open link 23 at the locking position shown by the two-dot-lines is moved to the unlocking position shown by the solid lines due to engagement between the first engaging groove 23*a* and the engaging pin 22*b*. In the above process, the door lock system is in the unlocked state capable of releasing the engagement between the latch 41 and the striker 45. The door can then be opened by opening the door using either the outside handle or the inside handle.

Figure 12:
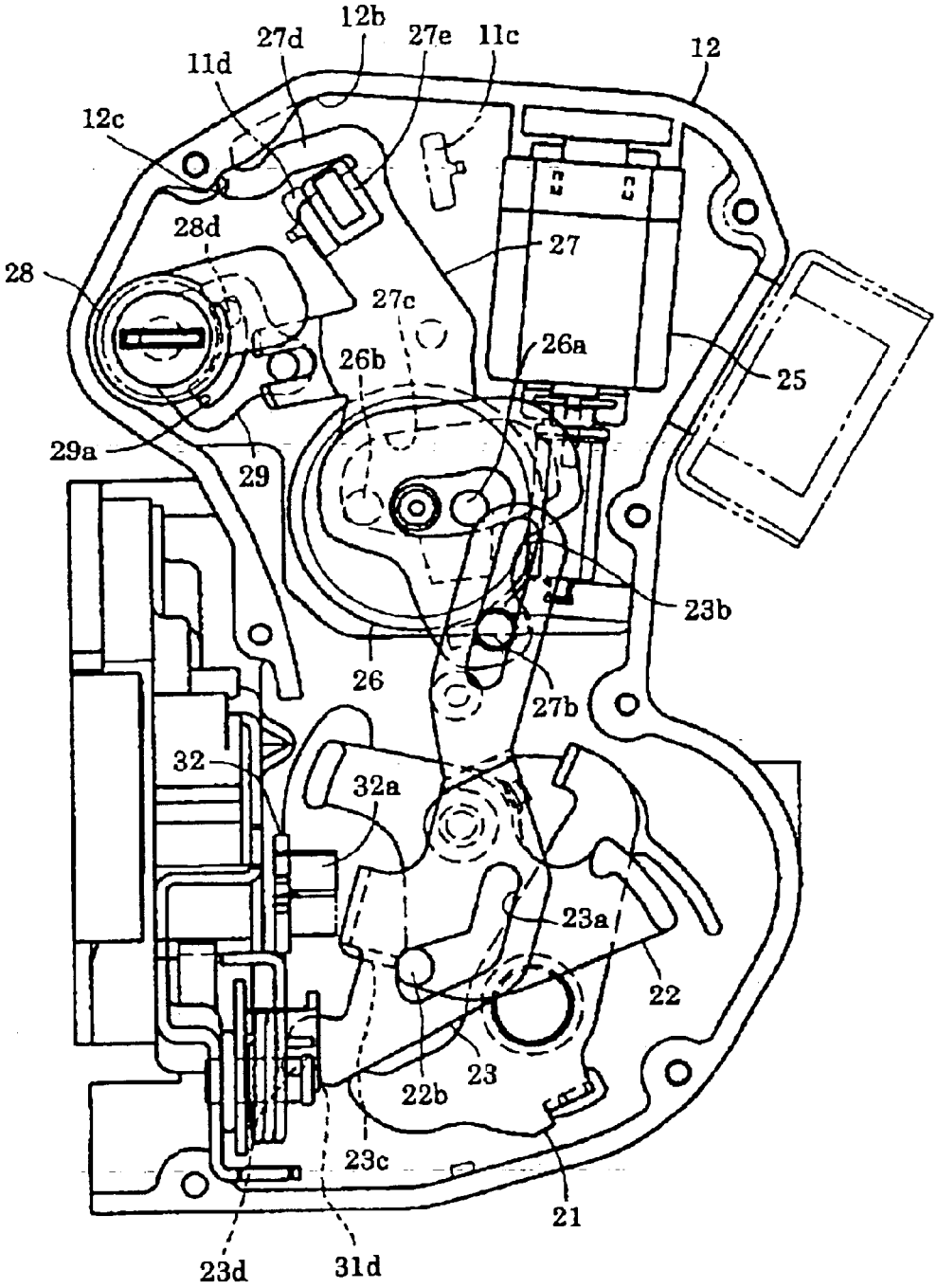
FIG. 12 shows a side view of the inside of the door lock system in a keyless locking operation.

Seventh operation mode (keyless locking operation): The door lock system is brought into the locked state in such a manner that while the door is opened, the locking knob is manually operated to bring the door lock system into the locked state and thereafter the door is closed. In the door lock system, when the outside handle is operated for opening the door while the door lock system is in the locked state, the opening lever 31 is rotated to push the open link 23 up as shown in FIG. 12. Thus, the engaging pin 22*b* of the canceling lever 22 is located at a downside of the first engaging groove 23*a* and is out of engagement with anything. When the door is closed in the above condition, the latch 41 is rotated by the striker 45. Then, the pawl 42 causes the lifting lever 32 to rotate, whereby the canceling lever 22 is rotated in the clockwise direction shown in FIG. 12. However, the engaging pin 22*b* of the canceling lever 22 is located in the first engaging groove 23*a* of the open link 23 and is out of engagement with anything, thereby not moving the open link 23 to the unlocking position. The open link 23 is therefore kept in the locking position. Thus, the door lock system can be in the locked state which is capable of releasing the engagement between the latch 41 and the striker 45 when the door is closed. In addition, if the door opening operation by the outside handle is interrupted after closing the door, the condition as shown in FIG. 12 is changed to the condition as shown in FIG. 8, whereby the door lock system remains in the locked state.

Figure 13:
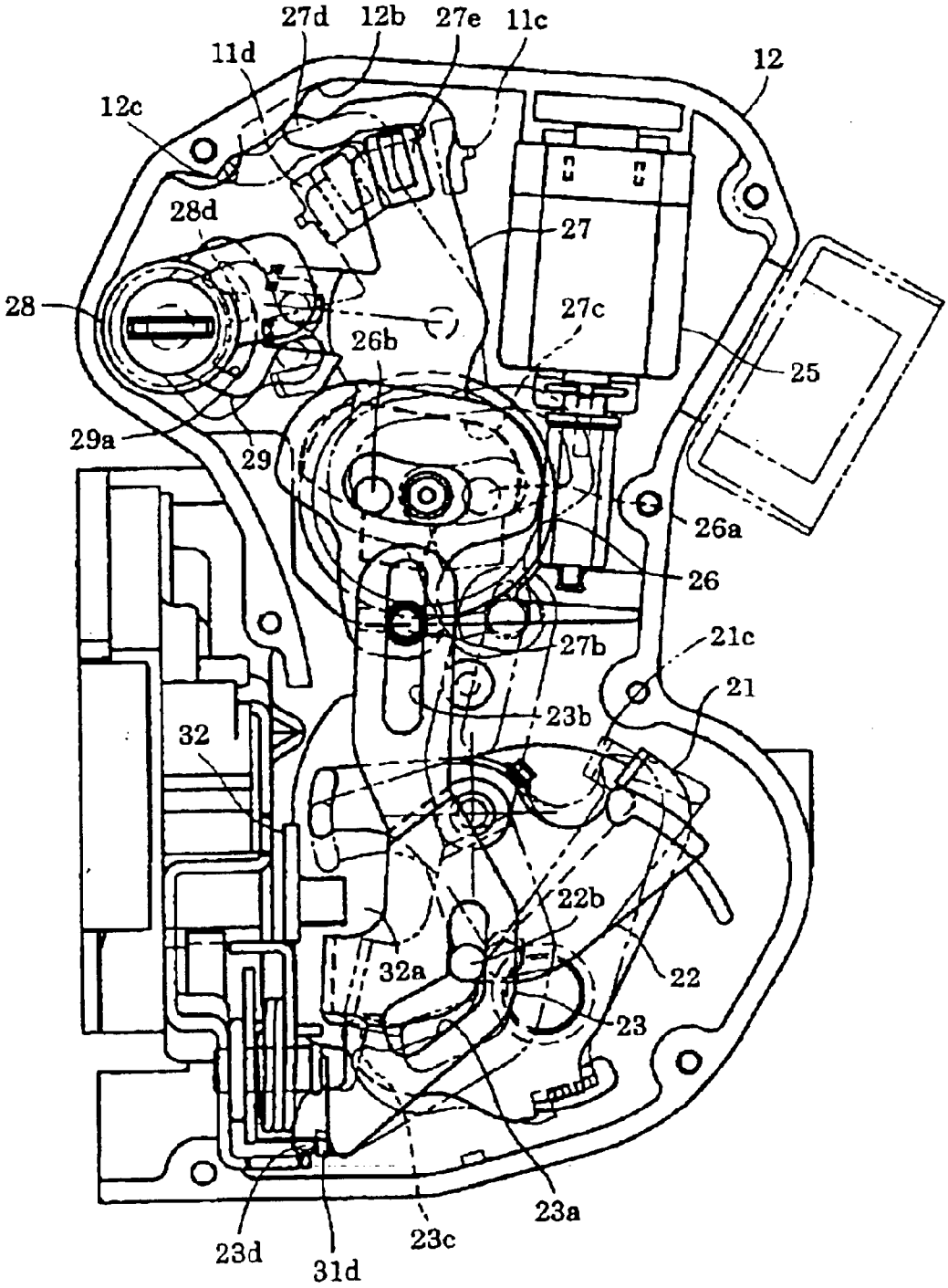
FIG. 13 shows a side view of the inside of the door lock system in a one-motion operation.

Eighth operation mode (one motion operation): In succession, the locked state of the door lock system is cancelled and the door is opened by opening the door using the inside handle when the door lock system is in the locked state which is capable releasing the engagement between the latch 41 and the striker 45. In the door lock system, when the inside handle is operated for opening the door, the second inside lever 51 and the first inside lever 21 are rotated as one unit. Then, the engaging projection 21*c* of the first inside lever 21 rotates the canceling lever 22, which causes the open link 23 to move from the locking position shown by the two-dot-lines in FIG. 13 to the unlocking position shown by the solid lines in FIG. 11 by the engagement between the first engaging groove 23*a* and the engaging pin 22*b*. The active lever 27 and the idling lever 29 are then moved from the locking position shown by the two-dot lines in FIG. 13 to the unlocking position indicated by the solid lines in FIG. 11 by the engagement between the second engaging groove 23*b* and the engaging pin 27*b*. The open link 23 is thus pushed up by the first inside lever 21, thereby causing the lifting lever 32 and the pawl 42 to rotate. Thereafter the door can be opened.

All members of the first link mechanism 20 and the second link mechanism 30 of the door lock system are accommodated within the housing 10. No members of these link mechanisms 20, 30 can be placed outside the housing 10. Thus each member of both the first link mechanism 20 and the second link mechanism 30 can not be operated from outside of the door through the gap between the door and the body of the vehicle. Therefore, the door lock system can keep the engagement between the latch 41 and the striker 45 thereby preventing the door from opening. In addition, since each member of both the first link mechanism 20 and the second link mechanism 30 is not exposed outside the housing 10, each of the members absolutely can not be exposed to water which enters the door.

In the door lock system, the housing 10 works as a protector accommodating structural members of the link mechanisms 20, 30. Thus, an added protector is not necessary as an additional member of the housing 10. Accordingly, increase in manufacturing cost, labor for assembling and the number of members can be avoided.

In the door lock system, all structural members of the first link mechanism 20 are accommodated within one of the first casing portion 11*a* of the main housing portion 11 and the first cover 12, and all structural members of the second actuating mechanism 30 are supported by the sub base plate 15 which is disposed between the second casing portion 11*b* of the main housing portion 11 and the second cover 13. Thus, the sub base plate 15 further supports the latch mechanism 40 together with the base plate 16. The door lock system is therefore significantly miniaturized in comparison to a conventional sub base plates. Thus, the entire door lock system is downsized.

The principles of the preferred embodiment described herein is therefore illustrative and not restrictive, the scope of the invention being indicated in the appended claims and all variations which come within the spirit and meaning of the claims are intended be embraced therein.

What we claimed is:

1. A door lock system for a vehicle comprising:

a latch mechanism adapted to a vehicle door and latching the vehicle door to a vehicle body;

a link mechanism including an electric driving source, and a plurality of lever members for selectively locking and unlocking the latch mechanism;

a housing accommodating the link mechanism, including the electric driving source, and the latch mechanism;

an insertion groove into which a striker is movable to be received by a portion of the latch mechanism to latch the vehicle door to the vehicle body;

the electric driving source being accommodated in an upper portion of the housing so that the entire electric driving source is above the insertion groove; the housing including a first cover, a second cover and a main body having a first dish-shaped casing portion and a second dish-shaped casing portion, the first casing portion including an opening, closed by the first cover, at one side thereof, the second casing portion connected to the first casing portion and perpendicular to each other, the second casing portion including an opening, closed by the second cover, at one side thereof;

a first space between the first cover and the first casing portion, with the electric driving source disposed within the first space;

the latch mechanism being supported by the second cover; and each of the lever members of the link mechanism being disposed within at least one of a) the first space defined between the first casing portion and the first cover and b) a second space defined between the second casing portion and the second cover.

2. A door lock system for a vehicle according to claim 1, wherein the part of the lever members and the electric driving source of the link mechanism are supported by the first casing portion and the first cover, and the other lever members of the link mechanism are supported by a base plate disposed between the second casing portion and the second cover.

3. A door lock system for a vehicle according to claim 2, wherein one of the lever members of the link mechanism includes an open link coupled to the electric driving source to selectively lock and unlock engagement of the latch mechanism; and another of the lever members includes a lifting lever coupled to the latch mechanism for being engagable and disengagable with the open link.

4. A door lock system for a vehicle according to claim 1, wherein the first casing portion and the second casing portion are integrally formed with one another.

5. A door lock system for a vehicle according to claim 1, wherein the latch mechanism is accommodated in a space between the second cover and a base plate that is secured to an open end of the second cover.

6. A door lock system for a vehicle comprising:

a housing comprised of a main body, a first cover and a second cover, the main body comprising a first casing portion and a second casing portion, the first casing portion having an open end closed by the first cover with a first space between the first cover and the first casing portion, the second casing portion having an open end closed by the second cover with a second space between the second cover and the second casing portion, the first and second casing portions being connected to each other and being oriented relative to one another such that the open end of the first casing portion and the open end of the second casing portion face in directions perpendicular to one another;

a latch mechanism adapted to latch a vehicle door to a vehicle body, the latch mechanism being accommodated in the housing;

an insertion groove into which a striker is movable to be received by a portion of the latch mechanism to latch the vehicle door to the vehicle body;

a link mechanism including an electric driving source and a plurality of lever members for selectively locking and unlocking the latch mechanism, the link mechanism, including the electric driving source being accommodated in the housing, with each of the lever members being accommodated in either the first space or the second space;

the electric driving source being accommodated in an upper portion of the housing so that the entire electric driving source is above the insertion groove;

the electric driving source being disposed within the first space; and the latch mechanism being supported by the second cover.

7. A door lock system for a vehicle according to claim 6, wherein the first casing portion and the second casing portion are integrally formed with one another.

8. A door lock system for a vehicle according to claim 6, wherein the latch mechanism is accommodated in a space between the second cover and a base plate that is secured to an open end of the second cover.

9. A door lock system for a vehicle according to claim 1, wherein the insertion groove is provided in a base plate attached to the housing.

10. A door lock system for a vehicle according to claim 6, wherein the insertion groove is provided in a base plate attached to the housing.

11. A door lock system for a vehicle according to claim 1, including a worm gear extending from the electric driving source.

12. A door lock system for a vehicle according to claim 1, including a worm gear extending from the electric driving source.

13. A door lock system for a vehicle according to claim 1, wherein the lever members of the link mechanism comprise an open link coupled to the electric driving source to selectively lock and unlock the latch mechanism, the open link being disposed in the first space.

14. A door lock system for a vehicle according to claim 13, wherein the open link is coupled to the electric driving source by way of an active link disposed in the first space, the active link being engaged with the electric driving source by virtue of a pin positioned in a slot, the active link also engaging the open link by virtue of a pin positioned in a slot.

15. A door lock system for a vehicle according to claim 6, wherein the lever members of the link mechanism comprise an open link coupled to the electric driving source to selectively lock and unlock the latch mechanism, the open link being disposed in the first space.

16. A door lock system for a vehicle according to claim 15, wherein the open link is coupled to the electric driving source by way of an active link disposed in the first space, the active link being engaged with the electric driving source by virtue of a pin positioned in a slot, the active link also engaging the open link by virtue of a pin positioned in a slot.

* * * * *